US009273534B2

(12) United States Patent
Merron et al.

(10) Patent No.: US 9,273,534 B2
(45) Date of Patent: Mar. 1, 2016

(54) TOOL WITH PRESSURE-ACTIVATED SLIDING SLEEVE

(71) Applicant: Halliburton Energy Services, Inc., Houston, TX (US)

(72) Inventors: Matthew James Merron, Dallas, TX (US); Kendall Pacey, Duncan, OK (US)

(73) Assignee: HALLIBURTON ENERGY SERVICES INC., Houston, TX (US)

( * ) Notice: Subject to any disclaimer, the term of this patent is extended or adjusted under 35 U.S.C. 154(b) by 204 days.

(21) Appl. No.: 13/957,625

(22) Filed: Aug. 2, 2013

(65) Prior Publication Data

US 2015/0034330 A1 Feb. 5, 2015

(51) Int. Cl.
*E21B 34/08* (2006.01)
*E21B 34/00* (2006.01)

(52) U.S. Cl.
CPC ..... *E21B 34/08* (2013.01); *E21B 2034/007* (2013.01)

(58) Field of Classification Search
CPC ..... E21B 34/14; E21B 34/103; E21B 34/102; E21B 34/10; E21B 2034/007; E21B 34/08
See application file for complete search history.

(56) References Cited

U.S. PATENT DOCUMENTS 4,292,988 A * 10/1981 Montgomery ..... 137/68.17
4,560,005 A 12/1985 Helderlie et al.
6,575,243 B2 6/2003 Pabst
8,167,049 B2 5/2012 Donald et al.
2004/0007872 A1* 1/2004 Gurjar et al. ..... 285/333
2011/0108272 A1 5/2011 Watson et al.
2011/0253383 A1 10/2011 Porter et al.
2011/0253391 A1 10/2011 Veit et al.
2012/0055681 A1 3/2012 Telfer
2012/0111574 A1 5/2012 Desranleau et al.
2012/0205121 A1 8/2012 Porter et al.
2013/0000740 A1 1/2013 Veit
2013/0056206 A1 3/2013 Jackson
2013/0081817 A1 4/2013 Norrid et al.
2013/0161017 A1 6/2013 King
2013/0180718 A1 7/2013 Fehr et al.

OTHER PUBLICATIONS

International Search Report and Written Opinion, Nov. 6, 2014, 1-10, Korean International Search Authority.

* cited by examiner

*Primary Examiner* — David Andrews
*Assistant Examiner* — Kristyn Hall

(57) ABSTRACT

A downhole tool and system for actuation of the tool. The tool includes a sliding sleeve assembly that is urged toward an opening position due to an interior pressure in the tool. A shear pin assembly hold the tool in the closed position. As pressure is increased to above a predetermined locking set point, a locking mechanism on the sliding sleeve radial engages the housing of the tool to lock the sliding sleeve to the housing. As pressure is further increased to a predetermined an activation set point, the shear pin assembly shears, but the sliding sleeve is maintained in the closed position by the locking mechanism. Only after the interior pressure is subsequently lowered to below a predetermined opening set point will the sliding sleeve shift to an open position.

15 Claims, 6 Drawing Sheets

TOOL WITH PRESSURE-ACTIVATED SLIDING SLEEVE

TECHNICAL FIELD

The present disclosure relates generally to oilfield equipment, and in particular to downhole tools.

BACKGROUND

Hydrocarbon-producing wells often are stimulated by hydraulic fracturing operations, wherein a servicing fluid such as a fracturing fluid or a perforating fluid may be introduced into a portion of a subterranean formation penetrated by a wellbore at a hydraulic pressure sufficient to create or enhance at least one fracture therein. Such a subterranean formation stimulation treatment may increase hydrocarbon production from the well.

In some wellbores, it may be desirable to individually and selectively create multiple fractures along a wellbore at a distance apart from each other, creating multiple "pay zones." The multiple fractures should have adequate conductivity, so that the greatest possible quantity of hydrocarbons in an oil and gas reservoir can be produced from the wellbore. Some pay zones may extend a substantial distance along the length of a wellbore. In order to adequately induce the formation of fractures within such zones, it may be advantageous to introduce a stimulation fluid via multiple stimulation assemblies positioned within a wellbore adjacent to multiple zones. To accomplish this, it is necessary to configure multiple stimulation assemblies for the communication of fluid via those stimulation assemblies. Thus, there is an ongoing need to develop new methods and apparatuses to enhance hydrocarbon production.

A wellbore stimulation assembly allows a well producer to create an open well condition at an entry point in a zone by increasing pressure and opening ports in the tool to the formation. One such tool known in the art operates by a sliding sleeve that shears pins at an actuation pressure, thereby allowing the sliding sleeve to move to an open position. This single set point actuation methodology, however, prevents a casing pressure test at maximum operating pressure if the shear pin set value is less than the maximum operating pressure. Alternatively, if the shear pin set value is greater than the maximum operating pressure, than the operating pressure must exceed the maximum operating pressure in order to open the tool.

Moreover, shear pins do not always part at the exact set value, and sliding sleeve friction affects the overall activation pressure. Cemented applications pose a particular challenge, because cement causes additional friction for sliding sleeves, and any cavities or passages have a tendency to collect cement. When pins shear at a higher pressure than the designed pressure, maximum operating pressure may be exceeded and casing failure may result. When pins shear at a lower pressure than the design pressure, the tool opens prematurely before the well pressure testing and inspection is completed.

BRIEF DESCRIPTION OF THE DRAWINGS

Embodiments are described in detail hereinafter with reference to the accompanying figures, in which.

DETAILED DESCRIPTION

Figure 1:
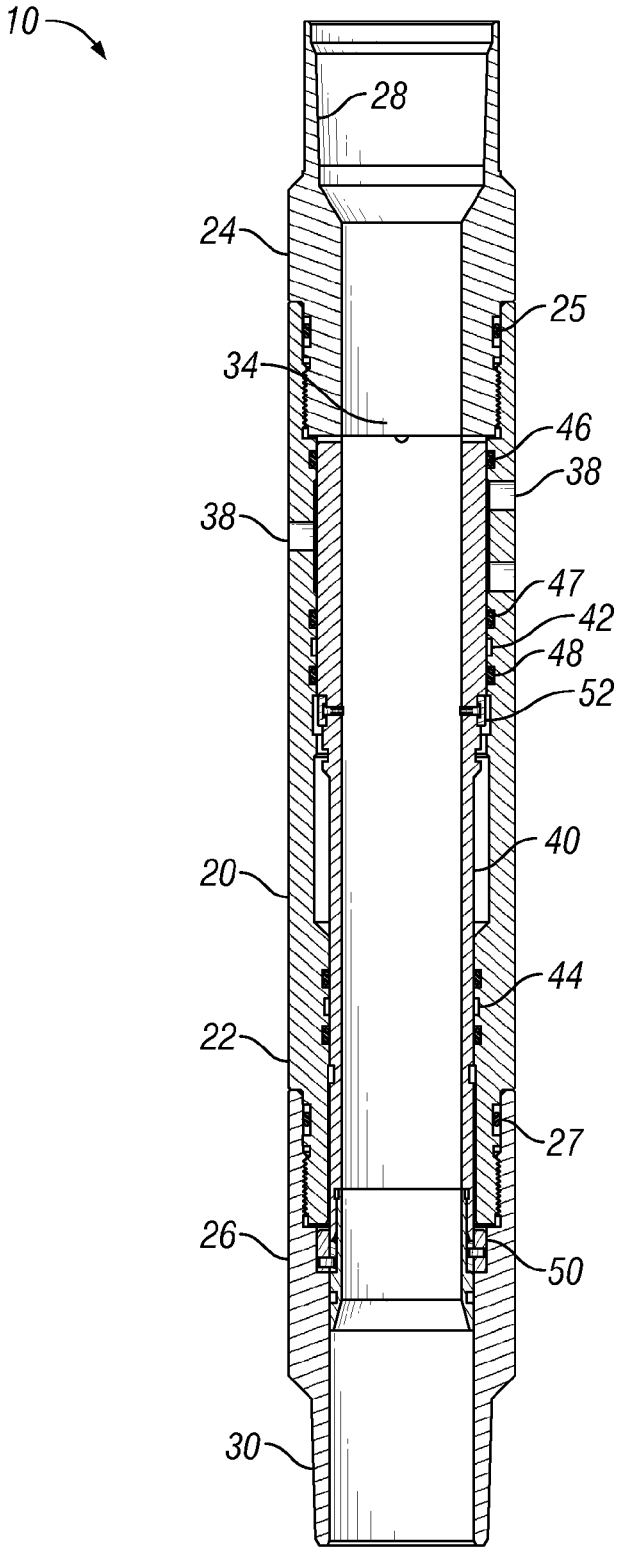
FIG. 1 is an axial cross section of a downhole tool with a pressure-activated sliding sleeve according to a preferred embodiment, showing a shear pin assembly that operates at an activation set point and locking mechanism that locks at a locking set point and unlocks at an opening set point.

FIG. 1 shows a downhole tool 10 with a pressure-activated sliding sleeve according to a preferred embodiment. Tool 10 is suitable for use as a wellbore stimulation, assembly, although it may also find application in tools for other purposes. A wellbore stimulation assembly ("WSA") serves as a section of well casing, which has a primary function to keep the earth from collapsing into the well.

Tool 10 has a cylindrical housing 20, which is formed of a central section 22, a box end section 24, and a pin end section 26. The box end section 24 and pin end section 26 are threaded to central section 22 with O-rings 25, 27 providing a seal between the respective sections. Box end section 24 terminates in a box fitting 28 and pin end section terminates in a pin fitting 30 for connection to other casing sections, as is known in the art. Housing 20 defines a central longitudinal bore 34 through which hydrocarbons can flow and tooling can be run.

Tool 10 includes a radial array of ports 38 formed through central section 22 of housing 20. Ports 38 allow hydrocarbons to flow into the well bore from the production zone or well fluids to flow into the production zone. Well producers may also use these ports 38 to stimulate the surrounding zone so that hydrocarbons flow more freely into the well bore.

A pressure-activated sliding sleeve assembly 40 is coaxially positioned within the central section 22 and pin end section 24 of housing 20. Optional polytetrafluoroethylene rings 42, 44 provide a centralizing bearing surface for sliding sleeve assembly 40. Sliding sleeve assembly 40 and O-rings 46, 47, 48 located above and below the array of ports 38, which provide a dynamic seal between sleeve assembly 40 and the interior circumferential surface of central section 22, cooperate to form a valve for isolating ports 38 from central bore 34. FIG. 1 shows the sliding sleeve assembly 40 located in an initial "shut" position.

Figure 2:
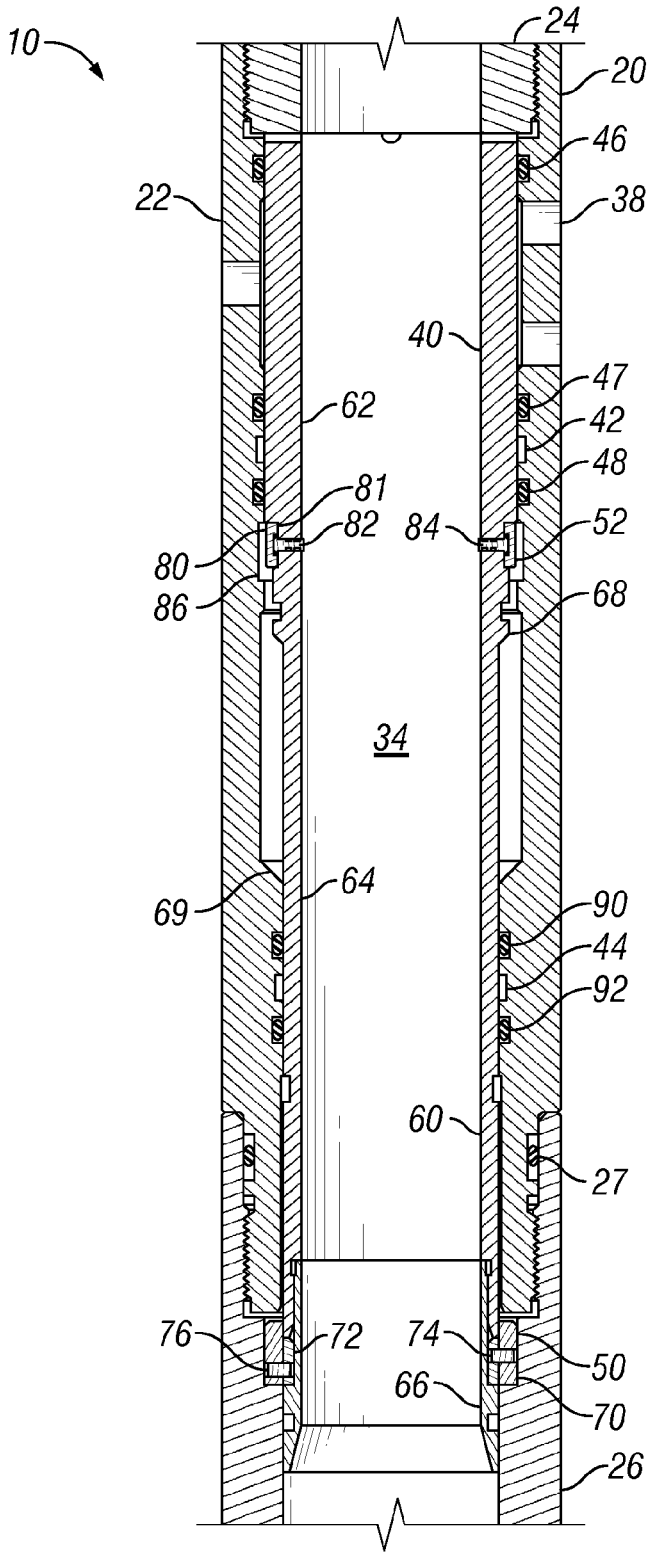
FIG. 2 is an enlarged axial cross section of a portion of the downhole tool of FIG. 1 shown in an initial run-in state with an interior pressure less than the opening set point.

A ring-shaped shear pin assembly 50 and a "C"-shaped locking mechanism 52 hold tool 10 in the shut position. Once pressure has reached a certain high pressure threshold, for example, a hydrostatic test pressure, and the pressure is subsequently reduced below a second lower opening pressure, tool 10 opens so that ports 38 are in fluid communication with central bore 34. FIG. 2 is a slightly enlarged drawing of downhole tool 10, shown with sliding sleeve assembly 40 in an initial shut position. Sliding sleeve assembly 40 includes of a primary sleeve 60 and an extension sleeve 66, which is ideally threaded into the pin end of primary sleeve 60 and which captures shear pin assembly 50 about sliding sleeve assembly 40, as described in greater detail below.

Primary sleeve includes a region 62 having a greater outer diameter located toward the box end of the tool and a region 64 having a smaller outer diameter located towards the pin end of the tool. Likewise, central section 22 of housing 20 is characterized by a larger inner diameter towards the box end and a smaller inner diameter towards the pin end. The axial dimensions of the larger and smaller inner and outer diameters is such that primary sleeve 60 can travel axially within central section 22 only a limited but sufficient distance so as to clear ports 38 in the open position. A radially extending flange 68 formed on primary sleeve 60 will seat against a shoulder 69 formed within central section 22 when tool 10 is in the open position.

Shear pin assembly 50 includes an outer ring 70 that abuts and is slideably engaged about an inner ring 72. One or more holes are formed radially through outer and inner rings 70, 72, and shear pins 74, 76 are pressed into these holes. When an axial force on inner ring 72 with respect to outer ring 70 exceeds the shear force of pins 74, 76 ("activation pressure"), the inner sleeve 72 will slide with respect to the outer sleeve 70. The outer diameter of inner ring 72 is the same as the outer diameter of region 64 of primary sleeve 60.

Locking mechanism 52 is designed to extend radially into locking engagement with housing 20 when the pressure within bore 34 exceeds a locking set point and to fully retract back into sliding sleeve assembly 40 when the internal pressure is less than an opening set point. Such functionality may be accomplished with one or more radially-oriented pistons that act under the influence of the internal pressure against a spring force that urges the pistons inward. Locking mechanism may engage housing 20 by being received into one or more recesses, or it may simply abut housing 20 and use friction to lock, in a manner similar to a drum brake.

In a preferred embodiment, locking mechanism 52 includes a resilient "C"-shaped clip 80 and two pin-shaped piston assemblies 82, 84. Primary sleeve includes a circumferential groove 81 into which clip 80 is received and a pair of radial holes 85 formed through the sleeve, generally spaced 180 degrees apart and positioned within the groove, into which piston assemblies 82, 84 are received. The radial location of pin-shaped piston assemblies 82, 84 can be also be other than 180 degrees as appropriate to adjust the force applied to "C"-shaped clip 80.

Piston assemblies 82, 84 each ideally include one or two O-rings 91, 92 (FIG. 6) to provide a dynamic seal. Ideally, the relaxed dimension of "C"-shaped clip 80 is manufactured with a preload such that fits snuggly within the circumferential groove 81 and will not come loose out of the groove 81 without outward radial force applied to the clip.

The inner diameter of central section 22 includes a circumferential groove 86 having a diameter sufficiently great to allow "C"-shaped clip 80 to expand into groove 86 under an increased pressure ("locking pressure") in bore 34 due to outward radial movement of piston assemblies 82, 84. The axial length of groove 86 is approximately the axial length of "C"-shaped clip 80 plus the greatest diameter of shear pins 74, 76. This feature limits axial movement of sliding sleeve assembly 40 when pins 74, 76 are sheared until pressure in bore 34 is lowered again to allow "C"-shaped clip 80 fully retract into its groove 81 in primary sleeve 60 ("opening pressure"), as described in greater detail below. The edges of are preferably tapered, for example at about 85 degrees, to prevent "C"-shaped clip 80 from being pinched within groove 86 under the axial loading of sliding sleeve assembly 40 and failing to retract into groove 81 when the interior pressure is subsequently reduced.

Tool 10 is assembled generally as follows: First, piston assemblies 82, 84 are inserted into their respective holes formed in primary sleeve 22 from the outside in, and "C"-shaped clip 80 is fitted into the circumferential groove 81 formed about primary sleeve 22, which holds piston assemblies 82, 84 in place and provides the inward spring force on piston assemblies 82, 84 to urge locking mechanism 52 into an unlocked position. Next, primary sleeve 60 is axially inserted, pin end first, into the box end of central section 22 of housing 20. The box end section 24 may thereafter be threaded into the central section thereby capturing primary sleeve 60. Shear pin assembly 50 is inserted over the box end of extension sleeve 66, and the box end extension sleeve 66 is threaded into the pin end of primary sleeve 60. Finally, pin end section 26, which includes a recess in its inner diameter that accommodates outer ring 70 of shear pin assembly 50, is threaded to central section 22, thereby forcing sliding sleeve assembly 40 into the shut position.

Sliding sleeve assembly 40 acts as a piston within housing 20. At the larger outer diameter section 62, O-rings 46, 47, 48 seal against the inner diameter of housing 20. At the smaller outer diameter section 64, O-rings 90, 92 seal against the inner diameter of housing 20. Because the inner diameter of sliding sleeve assembly 40 is constant, the box end of sliding sleeve assembly 40 has a larger effective surface area than the pin end, and sliding sleeve assembly 40 is therefore subject to a net axial force urging it towards the pin end of tool 10. As pressure in bore 34 is increased, the net axial force is increased.

Actuation of sliding sleeve assembly 40 to the "open" position, is now described in greater detail with reference to FIGS. 2-5. Tool 10 is designed so that opening pressure (the pressure to fully disengage locking mechanism 52) is lower than locking pressure (the pressure to fully engage locking mechanism 52 so as to provide a positive lock), which is turn is lower than activation pressure (the pressure to shear pins 74, 76).

In FIG. 2, tool 10 exists in an initial run in state. Bore pressure is at or below the opening pressure and below the both the locking pressure and the activation pressure. The "C"-shaped clip 80 is fully retracted.

Figure 3:
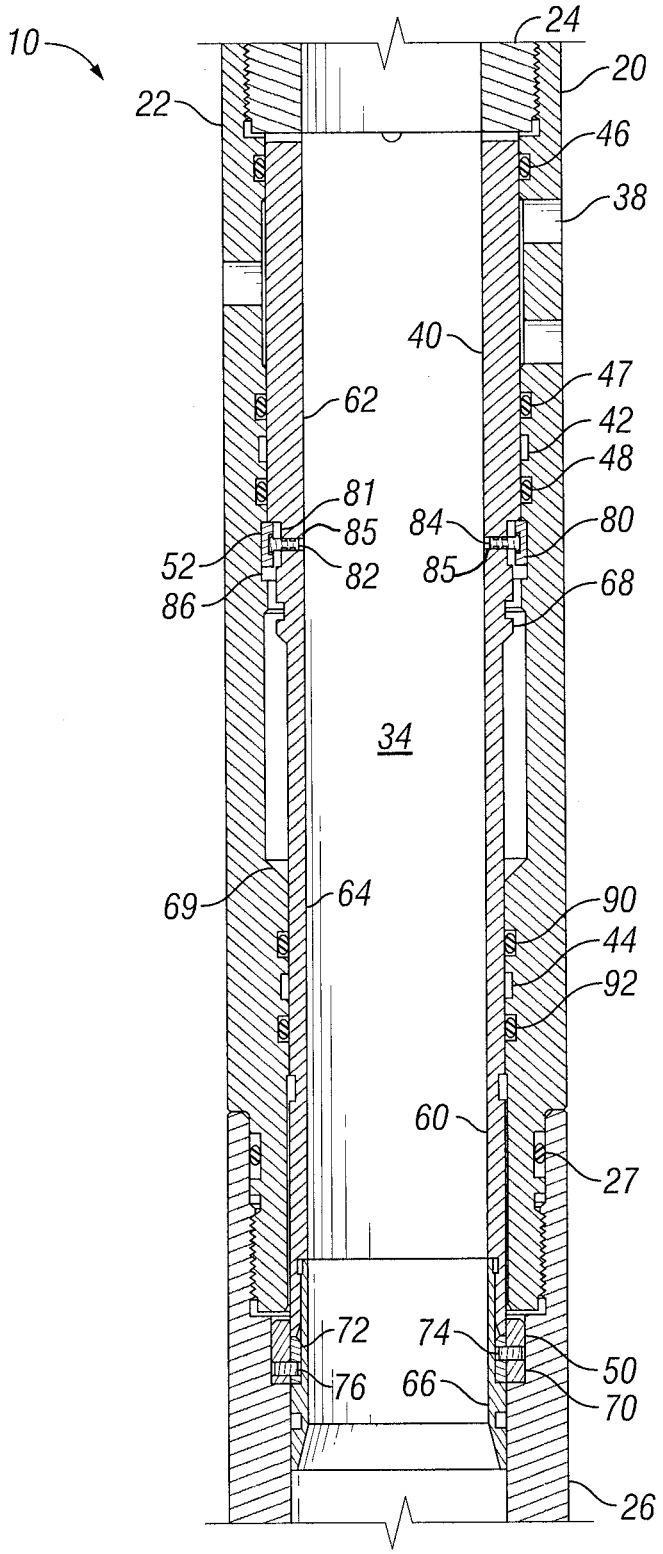
FIG. 3 is an enlarged axial cross section of a portion of the downhole tool of FIG. 1 shown in a locked but un-activated state with the interior pressure greater than the locking set point and less than the activation set point.

In FIG. 3, bore pressure has risen to locking pressure. Under the increased bore pressure, piston assemblies 82, 84 act upon and expand "C"-shaped clip 80 so that and locking mechanism 52 is fully engaged in groove 86. Because activation pressure has not been reached, shear pins 74, 76 hold sliding sleeve assembly 40 in the closed position. As pressure varies, "C"-shaped clip 80 expands and contracts accordingly.

Figure 4:
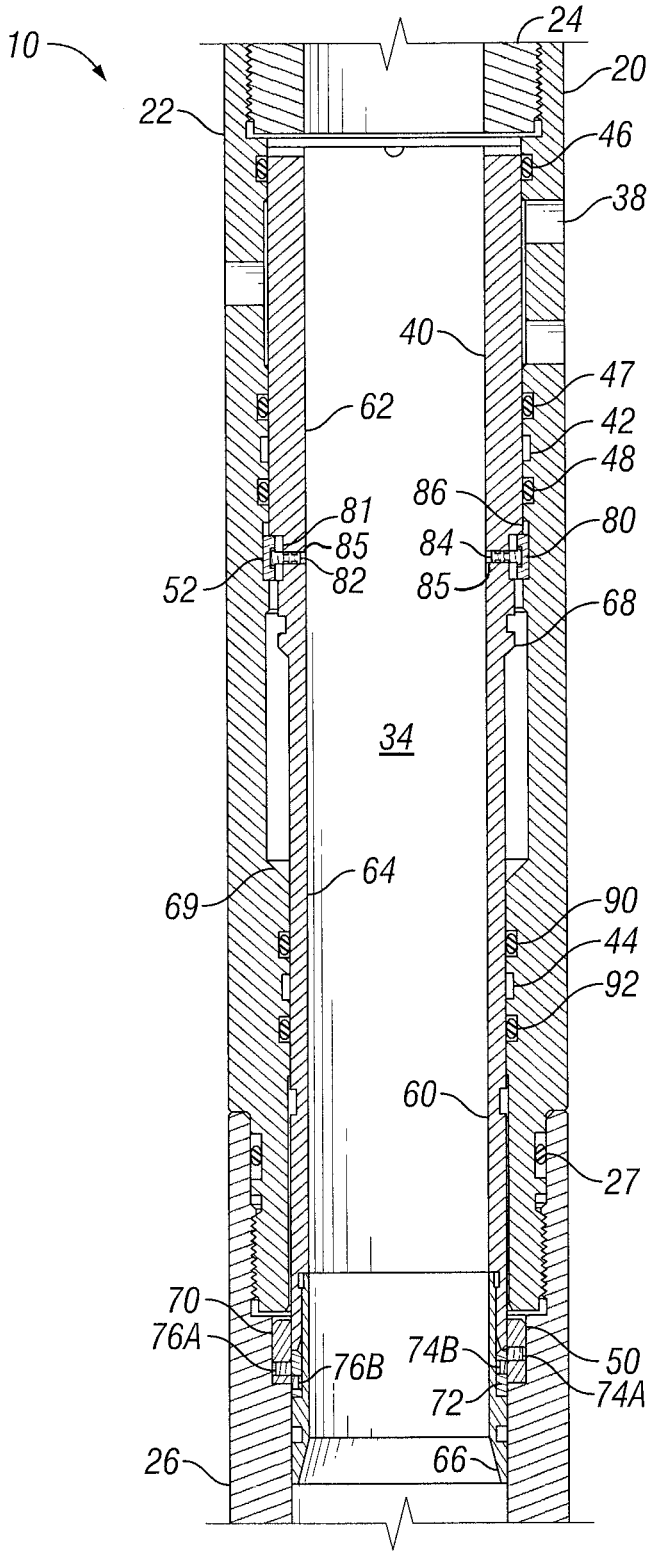
FIG. 4 is an enlarged axial cross section of a portion of the downhole tool of FIG. 1 shown in an activated but locked state, with pins sheared, and with the interior pressure having exceeded the activation set point and being greater than the locking set point.

FIG. 4 illustrates tool 10 after activation pressure is reached. Due to the axial force on sliding sleeve assembly 40, pins 74, 76 have sheared and remain as pin portions 74A, 76A within outer ring 70 and pin portions 74B, 76B within inner ring 72. Because locking pressure is still exceeded, locking mechanism 52 is engaged, which limits the axial movement to that necessary to allow pins 74, 76 to shear. Primary sleeve 60 with locking mechanism 52, extension sleeve 66, and inner ring 72 have shifted axially toward the pin end by the available axial distance within groove 86.

Figure 5:
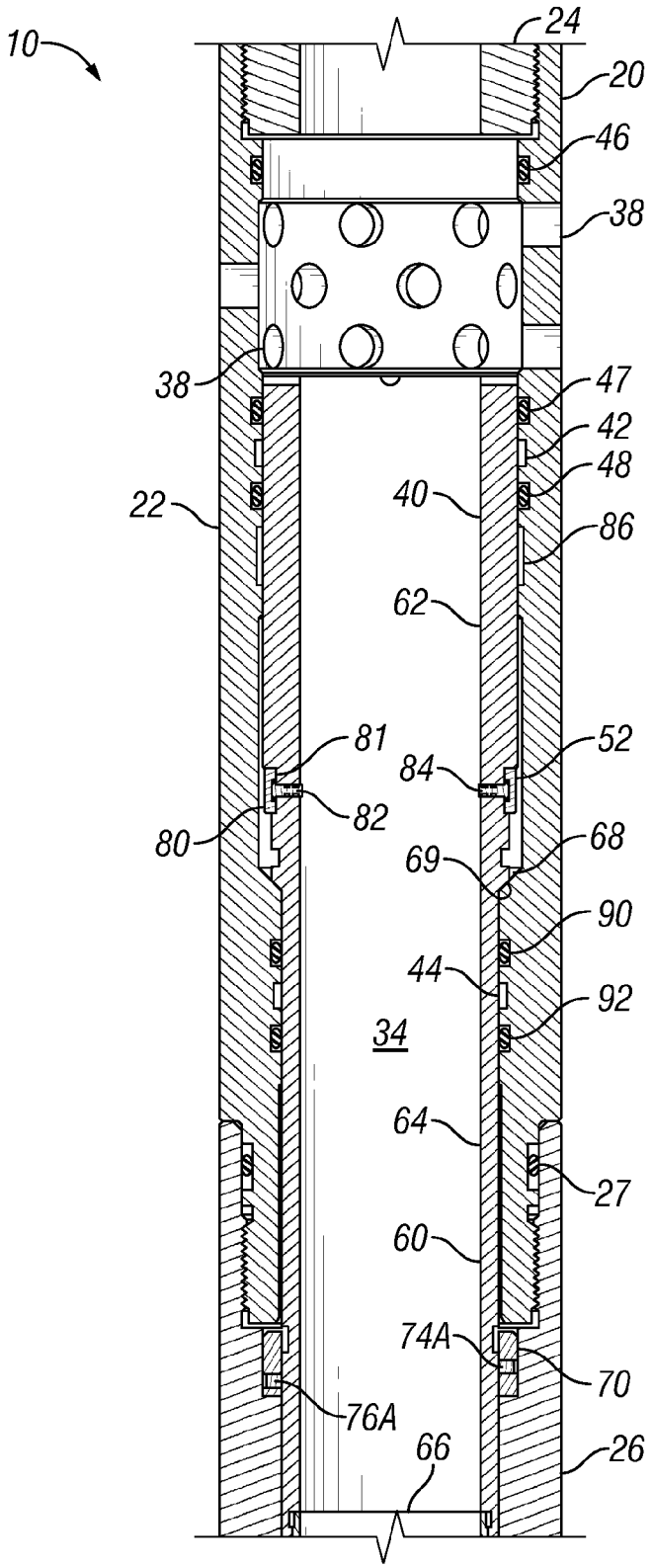
FIG. 5 is an enlarged axial cross section of a portion of the downhole tool of FIG. 1 shown in an open state, with pins sheared, the locking mechanism unlocked, the sliding sleeve shifted to the opened position, and the interior pressure less than the opening set point.

Finally, in FIG. 5 tool 10 is shown in an opened state, where ports 38 are in direct fluid communication with through bore 34. Bore pressure is lower than the opening pressure, which lowers the force on piston assemblies 82, 84 and allows "C"-shaped clip 80 to contract into groove 81. Accordingly.

sliding sleeve assembly 40 is unlocked and it axially travels toward the pin end until flange 68 is seated at shoulder 69.

Figure 6:
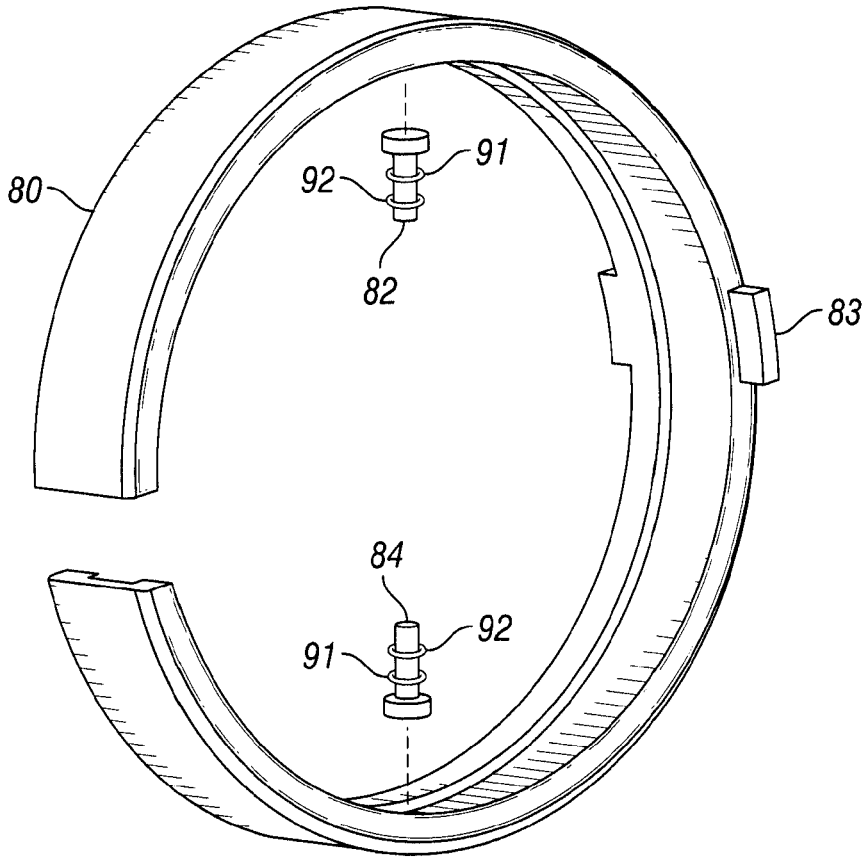
FIG. 6 is a perspective exploded diagram of a the locking mechanism of the tool of FIG. 1.

Referring to FIG. 6, in a preferred embodiment, "C"-shaped clip 80 includes one or more tabs 83, which are received into one or more corresponding recesses (not illustrated) in primary sleeve 60. The purpose of tabs 83 is to maintain a desired orientation of "C"-shaped clip 80 with respect to piston assemblies 82, 84 by preventing rotation about its axis of "C"-shaped clip 80, thereby preventing an unintended change in the designed locking set point.

Referring back to FIGS. 2-5, the design of tool 10 is further illustrated in an exemplar embodiment. Assume a requirement to test the well casing of a 10,000 foot vertical well at a maximum operating pressure of 10,000 psi. The hydrostatic head at 10,000 feet is about 4300 psi. Shear pin assembly 50 is designed to actuate at 9000 psi. Locking mechanism 52 is designed to begin to expand at about 6000 psi and to be fully engaged to provide a positive lock at about 8000 psi.

For example, the diameter of piston assemblies 82, 84 may be 0.22 inch, which at 6000 psi provides a radial force of 228 pounds at each piston for a combined force exerted upon "C"-shaped clip 80 of about 450 pounds. However, the piston diameter may be varied to achieve the desired radial force. Because of the small diameter of piston assemblies 82, 84 and because they will be fully engaged in sliding sleeve assembly 40 when pumping cement through bore 34 (i.e. the run-in state), cement should not enter the holes formed in primary sleeve 22 in which piston assemblies 82, 84 reside. Nevertheless, locking mechanism 52 may also be designed to provide redundancy, should one piston assembly not expand under pressure due, for example, due to cementing. The axial travel of piston assemblies 82, 84 is approximately 0.1 inches. "C"-shaped clip 80 is designed with 450 pounds of preload when seated in groove 81 of primary sleeve 60 so that it will begin to expand at 6000 psi and be fully expanded at 8000 psi (600 pounds by piston assemblies 82, 84).

In the well the operator first performs all the testing required for pressures less than 9000 psi. The operator is now ready for final verification test at 10,000 psi. As the operator increases pressure, at 6000 psi locking mechanism 52 starts to activate and by 8000 psi it is fully engaged with housing 20. At 9000 psi, shear pin assembly 50 shears, and sliding sleeve assembly 40 is held in the closed position by locking mechanism 52. The pressure test is completed at 10,000 psi. Tool 10 does not open until the interior pressure in bore 34 is reduced to about 6000 psi so as to disengage locking mechanism 52. Once locking mechanism 52 is disengaged, the axial differential pressure across sliding sleeve assembly 40 forces sliding sleeve assembly 40 to the open position.

The Abstract of the disclosure is solely for providing the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed:

1. A downhole tool comprising:

a housing having upper and lower ends;

a port formed through a wall of said housing;

a sleeve defining a through bore and slideably disposed within said housing, said through bore fluidly connecting said upper end with said lower end so as to subject said upper and lower ends of said housing and said through bore to a uniform interior pressure throughout, said sleeve movable with respect to said housing between a shut position, in which the sleeve covers and fluidly isolates said port from said upper and lower ends of said housing, and an open position, in which said sleeve uncovers said port and said port is in fluid communication with said upper and lower ends;

a shear pin directly connecting said sleeve to said housing so as to fix said sleeve in said shut position until said interior pressure reaches an activation pressure; and a locking mechanism directly connecting said sleeve to said housing so as to hold said sleeve in said shut position when said interior pressure exceeds a locking pressure and to not restrict movement of said sleeve with respect to said housing when said interior pressure drops below an opening pressure; wherein said locking pressure is greater than said opening pressure and said activation pressure is greater than said locking pressure; whereby when said interior pressure reaches said activation pressure, said shear pin shears, and said locking mechanism holds said sleeve in said shut position until said interior pressure drops below said opening pressure.

2. The downhole tool of claim 1 wherein:

said sleeve is dimensioned so that an axial force is applied on said sleeve in a direction urging said sleeve toward said open position due to said interior pressure.

3. The downhole tool of claim 1 wherein:

said locking mechanism includes a plurality of radially oriented pistons that are urged inward under spring pressure and urged outward due to the interior pressure.

4. The downhole tool of claim 3 wherein:

an interior surface of said housing includes a recess dimensioned to receive at least a portion of said locking mechanism when said interior pressure exceeds said locking pressure.

5. The downhole tool of claim 1 wherein:

said locking mechanism includes a "C"-shaped clip and first and second pistons;

an outer surface of said sleeve includes a first circumferential groove dimensioned to receive said clip; and said sleeve includes first and second radially-oriented holes dimensioned to receive said first and second pistons, respectively, so that said first and second pistons operate to radially expand said clip when said interior pressure increases.

6. The downhole tool of claim 5 wherein:

said first circumferential groove and said clip are dimensioned so that said clip fits flush within said first circumferential groove when said interior pressure is less than said opening pressure.

7. The downhole tool of claim 5 wherein:

an interior surface of said housing includes a second circumferential groove dimensioned to receive at least a portion of said clip when said interior pressure exceeds said locking pressure.

8. The downhole tool of claim 1 wherein:

said downhole tool is a wellbore stimulation assembly.

9. A method for actuating a downhole tool, said tool having a housing and a sleeve slideably disposed within said housing, the method comprising:

fluidly coupling an upper end of said housing to a lower end of said housing by a through bore of said sleeve;

subjecting said upper and lower ends of said housing and said through bore to a uniform interior pressure throughout;

directly holding said sleeve in a shut position with respect to said housing against an influence of said interior pressure by a shear pin;

selectively directly connecting said sleeve to said housing by a locking mechanism on the basis of said interior pressure;

raising said interior pressure to exceed a locking pressure to cause said locking mechanism to engage said sleeve to said housing; then raising said interior pressure to an activation pressure to shear said shear pin, said engaged locking mechanism holding said sleeve in said shut position; and then lowering said interior pressure to an opening pressure to cause said locking mechanism to disengage said sleeve from said housing and allowing said influence of said interior pressure to move said sleeve to an open position.

10. The method of claim 9 further comprising:

preventing fluid communication between said interior and a port formed through a wall of said housing by said sleeve when located in said shut position; and allowing fluid communication between said interior and said port by said sleeve when located in said open position.

11. The method of claim 9 wherein:

said locking pressure is greater than said opening pressure and said activation pressure is greater than said locking pressure.

12. The method of claim 9 further comprising:

carrying said locking mechanism on said sleeve; and radially engaging said housing by said locking mechanism.

13. The method of claim 12 further comprising:

providing a recess in said housing; and extending at least a portion of said locking mechanism into said recess.

14. The method of claim 13 wherein:

said recess is a groove formed in said housing; and said locking mechanism includes a "C"-shaped clip.

15. The method of claim 12 wherein:

said locking mechanism includes a radially-oriented piston assembly.

* * * * *